US007649504B2

(12) United States Patent
Baldauf

(10) Patent No.: US 7,649,504 B2
(45) Date of Patent: Jan. 19, 2010

(54) BACKFIRE ANTENNA WITH UPWARDLY ORIENTED DIPOLE ASSEMBLY

(75) Inventor: John E. Baldauf, Redondo Beach, CA (US)

(73) Assignee: The Boeing Company, Chicago, IL (US)

( * ) Notice: Subject to any disclaimer, the term of this patent is extended or adjusted under 35 U.S.C. 154(b) by 232 days.

(21) Appl. No.: 11/829,636

(22) Filed: Jul. 27, 2007

(65) Prior Publication Data

US 2009/0027289 A1 Jan. 29, 2009

(51) Int. Cl.
*H01Q 19/10* (2006.01)

(52) U.S. Cl. ..... 343/837; 343/836; 343/781; 343/789; 343/819; 343/840

(58) Field of Classification Search ..... 343/726, 343/767, 789, 815, 819, 837, 872
See application file for complete search history.

(56) References Cited

U.S. PATENT DOCUMENTS

| | | | | |
|---|---|---|---|---|
| 3,192,528 | A | 6/1965 | Sleeper et al. | |
| 3,355,740 | A * | 11/1967 | Mayes | 343/792.5 |
| 3,742,513 | A * | 6/1973 | Ehrenspeck | 343/817 |
| 3,774,223 | A * | 11/1973 | Ehrenspeck et al. | 343/779 |
| 3,858,221 | A * | 12/1974 | Harrison et al. | 343/815 |
| 4,005,433 | A * | 1/1977 | Tsuda | 343/819 |
| 4,131,896 | A * | 12/1978 | Miller | 343/815 |
| 4,183,027 | A * | 1/1980 | Ehrenspeck | 343/726 |
| 4,897,664 | A * | 1/1990 | Killackey et al. | 343/789 |
| 5,532,707 | A * | 7/1996 | Klinger et al. | 343/793 |

FOREIGN PATENT DOCUMENTS

JP 2000124733 4/2000

OTHER PUBLICATIONS

Ehrenspeck, "A New Class of Medium-Size High-Efficiency Reflector Antennas," IEEE Transactions on Antennas and Propagation, pp. 329-332, 1974.
Ehrenspeck, "The Short-Backfire Antenna," Proceedings of the IEEE, pp. 1138-1140, 1965.
Ohmori et al., "An Improvement in Electrical Characteristics of a Short Backfire Antenna," IEEE Transactions on Antennas and Propagation, vol. AP-31, No. 4, pp. 644-646, 1983.
International Search Report dated Oct. 16, 2008 for International Application No. PCT/US2008/070831.
Rayner et al., "FD-TD design of short backfire antennas," IEE Proceedings: Microwaves, Antennas and Propagation, vol. 144, No. 1, pp. 1-6, (1997).

* cited by examiner

*Primary Examiner*—Douglas W Owens
*Assistant Examiner*—Chuc D Tran
(74) *Attorney, Agent, or Firm*—Rozenblat IP LLC

(57) ABSTRACT

In one embodiment, a backfire antenna comprises a cup-shaped member defining an outer aperture and an interior cavity, a splash-plate disposed within a plane, and a dipole assembly comprising first and second arms. The first and second arms are both oriented non-parallel to the splash-plate towards the plane.

26 Claims, 8 Drawing Sheets

BACKFIRE ANTENNA WITH UPWARDLY ORIENTED DIPOLE ASSEMBLY

BACKGROUND

Backfire antennas are good antennas for space applications and other applications where ruggedness is needed. These antennas typically have a single dipole that illuminates a cavity. The single dipole is typically oriented horizontally and located below the cavity aperture with a parallel splash-plate disposed over it. These antennas may have low losses due to the need for only one dipole feed and may produce linear or circular polarization simultaneously when combined with the appropriate feed network and crossed dipoles. However, one or more of the existing backfire antennas may have narrow bandwidth, may have low efficiency and low directive gain due to poor aperture distribution, may have a high voltage standing wave ratio, and/or may require the use of a large splash-plate.

A backfire antenna, and method of use, is needed to decrease one or more problems associated with one or more of the existing backfire antennas and/or methods of use.

SUMMARY

In one aspect of the disclosure, a backfire antenna comprises a cup-shaped member defining an outer aperture and an interior cavity, a splash-plate disposed within a plane, and a dipole assembly comprising first and second arms. The first and second arms are both oriented non-parallel to the splash-plate towards the plane.

In another aspect of the disclosure, a method of using a backfire antenna is disclosed. In one step, a backfire antenna is provided comprising a cup-shaped member defining an outer aperture and an interior cavity, a splash-plate disposed within a plane, and a dipole assembly comprising first and second arms. The first and second arms are both oriented non-parallel to the splash-plate towards the plane. In another step, fields are radiated by currents on the first and second arms. The orientation of the first and second arms produces a broad radiation pattern below the first and second arms, and produces a narrow radiation pattern above the first and second arms. In still another step, the broad radiation pattern is reflected off surfaces of the interior cavity. In yet another step, the narrow radiation pattern is reflected off the splash-plate towards the interior cavity. The fields reflected from the cavity interior may produce the field aperture distribution in the cavity aperture that in turn may produce a high directive gain of the antenna.

These and other features, aspects and advantages of the disclosure will become better understood with reference to the following drawings, description and claims.

DETAILED DESCRIPTION

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims.

Figure 1:
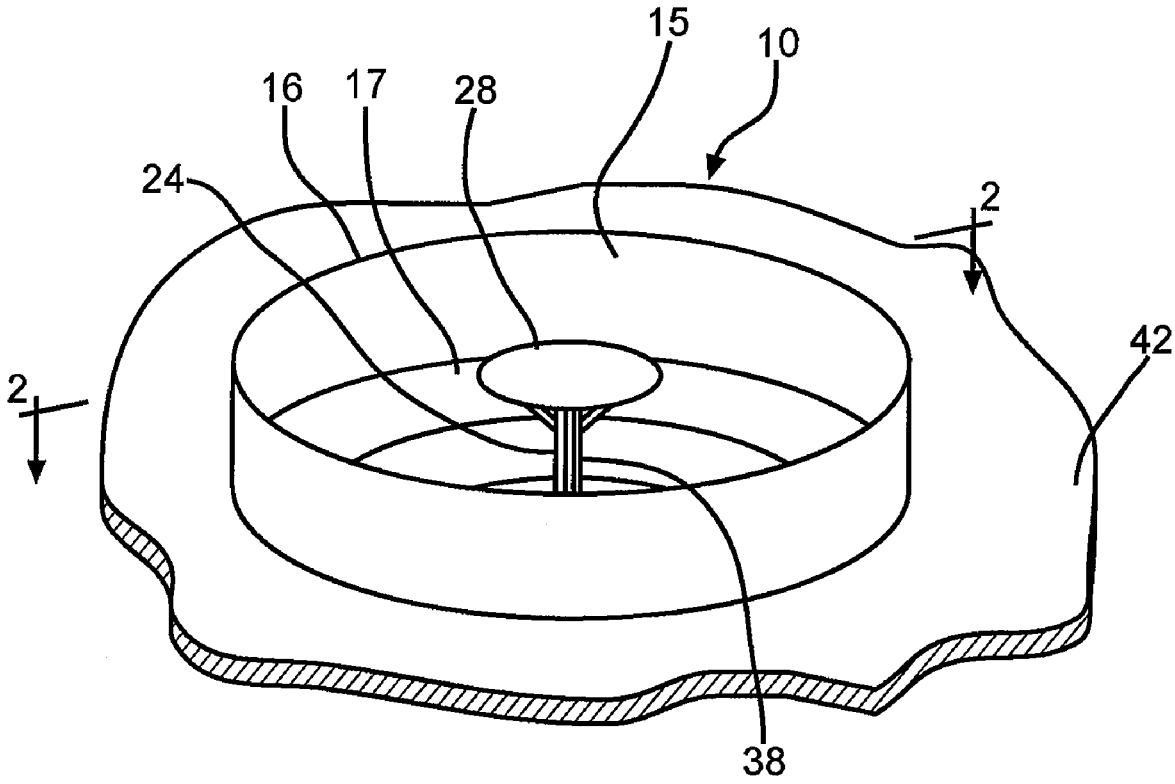
FIG. 1 shows a top-side perspective view of one embodiment of a backfire antenna.
Figure 2:
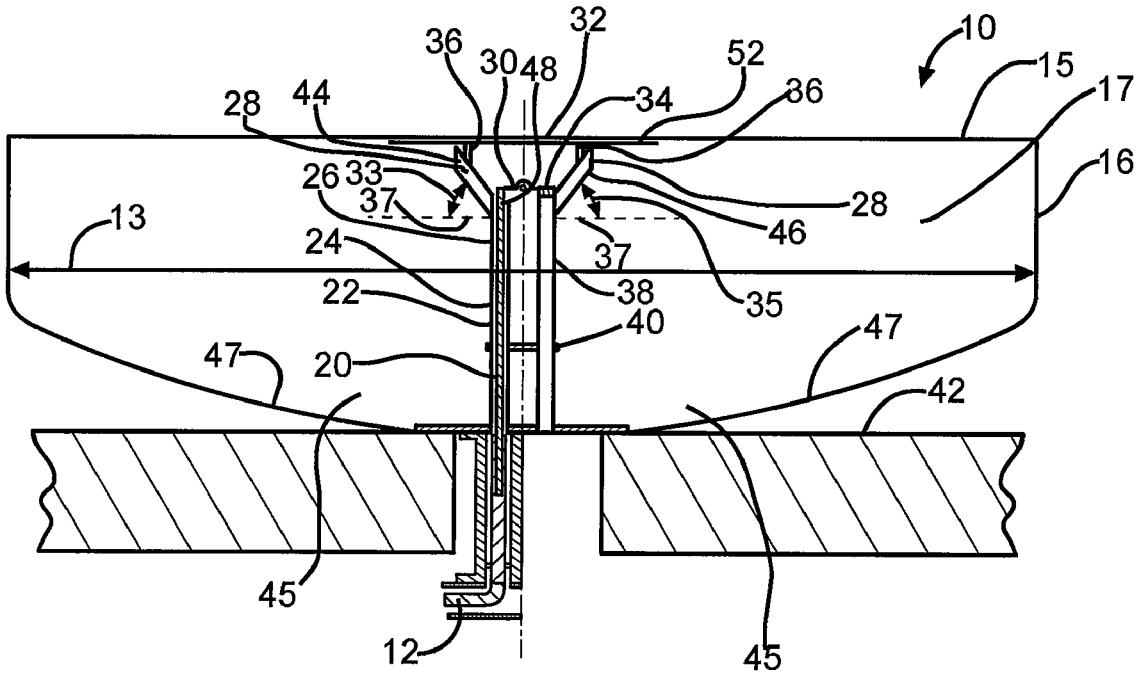
FIG. 2 shows a cross-section view through line 2-2 of FIG. 1.

FIG. 1 shows a top-side perspective view of one embodiment of a backfire antenna 10. FIG. 2 shows a cross-section view through line 2-2 of FIG. 1. This type of antenna may be used in a wide variety of applications, including in part: as a high efficiency antenna in the 2 to 2.5 wavelength diameter size for satellite applications, in mobile marine (water) and terrestrial applications mounted to vehicles, and for other antenna applications. Antennas having wavelength diameter sizes greater than 2.5 wavelengths may also be used with high efficiency. For purposes of this disclosure, the antenna will be described functionally as a transmit antenna. Those of ordinary skill in the art understand that antennas are reciprocal devices that have the same directive gain, radiation pattern, voltage standing wave ratio (VSWR), bandwidth, etc. whether they are transmitting or receiving.

As shown in FIGS. 1-2, the backfire antenna 10 may comprise: a feed network 12; a cup shaped member 16; an inner conductor 20; an outer conductor 22; a live leg 24; spacers 26; dipole assembly 28; cross-over 30; splash-plate 32; dummy I/C 34; splash-plate support 36; dead leg 38; and shorting ring 40. In other embodiments, the backfire antenna 10 may comprise varying number, type, and size components in varying orientations and configurations. The backfire antenna 10 may be attached to a panel 42 of a structure. The cup-shaped member 16 may be metallic and may have an open outer aperture 15 and an interior cavity 17, within which components of the backfire antenna 10 may be disposed. A diameter 13 of the cavity 17, may be in a range of 2 to 2.5 wavelengths.

The splash-plate 32, which may be metallic and in a circular, rod, or cross shape, may be disposed at or near the outer aperture 15 of the interior cavity 17 of the cup-shaped member 16. The dipole assembly 28 may comprise first and second arms 44 and 46 which are disposed within the cavity 17 below the splash-plate 32. Each of the first and second arms 44 and 46 may be in the range of ⅙ to ⅓ wavelengths long. The first and second arms 44 and 46 of the dipole assembly 28 are each oriented non-parallel to the splash-plate 32 in upward configurations, at equal respective angles 33 and 35 within a range of 15 to 35 degrees relative to the horizontal plane 37, directed towards a plane 52 within which the splash-plate 32 is disposed. In another embodiment, the angles 33 and 35 may be in the range of 10 to 40 degrees. In still another embodiment, the angles 33 and 35 are each 30 degrees. The first and second arms 44 and 46 of the dipole assembly 28 form an upward V-shape. In other embodiments, the first and second arms 44 and 46 may comprise various upward shapes, sizes, and configurations.

The splash-plate 32 may be designed to reflect fields radiating by currents on the first and second arms 44 and 46 of the dipole assembly 28. The cavity 17 may provide directivity to the fields radiating from the first and second arms 44 and 46. Together, the first and second arms 44 and 46, the splash-plate 32, and the cavity 17 may control the distribution of the fields within the cavity 17. The splash-plate support 36 may comprise non-conductive structural members which support the splash-plate 32 in a position above the first and second arms 44 and 46 of the dipole assembly 28.

The feed network 12 may comprise the network feeding the antenna 10. The feed network 12 may comprise varying feed networks known in the art such as an RF connector.

A signal to be transmitted by the antenna 10, such as a high frequency wave, may enter through a coaxial transmission line 19 consisting of the inner conductor 20 which is concentrically disposed within the outer conductor 22. The live leg 24 may comprise the outer conductor 22 overlying the inner conductor 20. The concentricity of the inner and outer conductors 20 and 22 may be maintained by the use of non-conductive spacers 26 spaced between them. The inner conductor 20 may exit through a hole 48 in the top of the live leg 24 of the antenna 10 where the first arm 44 joins the live leg 24. The cross-over 30 may connect the top of the inner conductor 20 to the dummy I/C 34 on the second arm 46, which may be in turn connected to the dead leg 38. The second arm 46 may be joined to the dead leg 38 in proximity to the location of the dummy I/C connection 34 to the dead leg 38. The connection of the inner conductor 20, via the cross-over 30, to the dead leg 38 and second arm 46 may put the voltage of the inner conductor 20 on the second arm 46. The voltage of the outer conductor 22, which is also the live leg 24, may be conveyed to the first arm 44.

The signal exiting the inner conductor 20 may travel along the following three possible paths: (1) reflection back down the coaxial transmission line 19; (2) radiation from the first and second arms 44 and 46; and (3) propagation along the outside of the dead leg 38 and the live leg 24 which form what is known as a "twin line" transmission line. The shorting ring 40, which may also be called the balun short (balun is short for balanced to unbalanced transition) may electrically connect the outside of the live leg 24 and the dead leg 38 approximately ¼ of a wavelength from where the inner conductor 20 exits the live leg 24. As a result, the current may not propagate down the live leg 24 and may either radiate from the first and second arms 44 and 46 or reflect back into the coaxial transmission line 19 comprising the inner and outer conductors 20 and 22.

The ratio of the voltage and current at the point 48 where the inner conductor 20 exits the live leg 24 may be the input impedance of the antenna 10. By matching the input impedance of the input of the dipole assembly 28 to the characteristic impedance of the transmission line 19 formed by the inner and outer conductors 20 and 22, the reflection of the signal back into the coaxial transmission line 19 may be eliminated, resulting in all of the incident power and current radiating from the first and second arms 44 and 46. In other embodiments, the dipole assembly 28 may be fed in a multiplicity of ways, different types of shorting rings 40 may be utilized, and/or the dipole assembly 28 may be fed in a balanced manner eliminating the need for a shorting ring 40.

Figure 3:
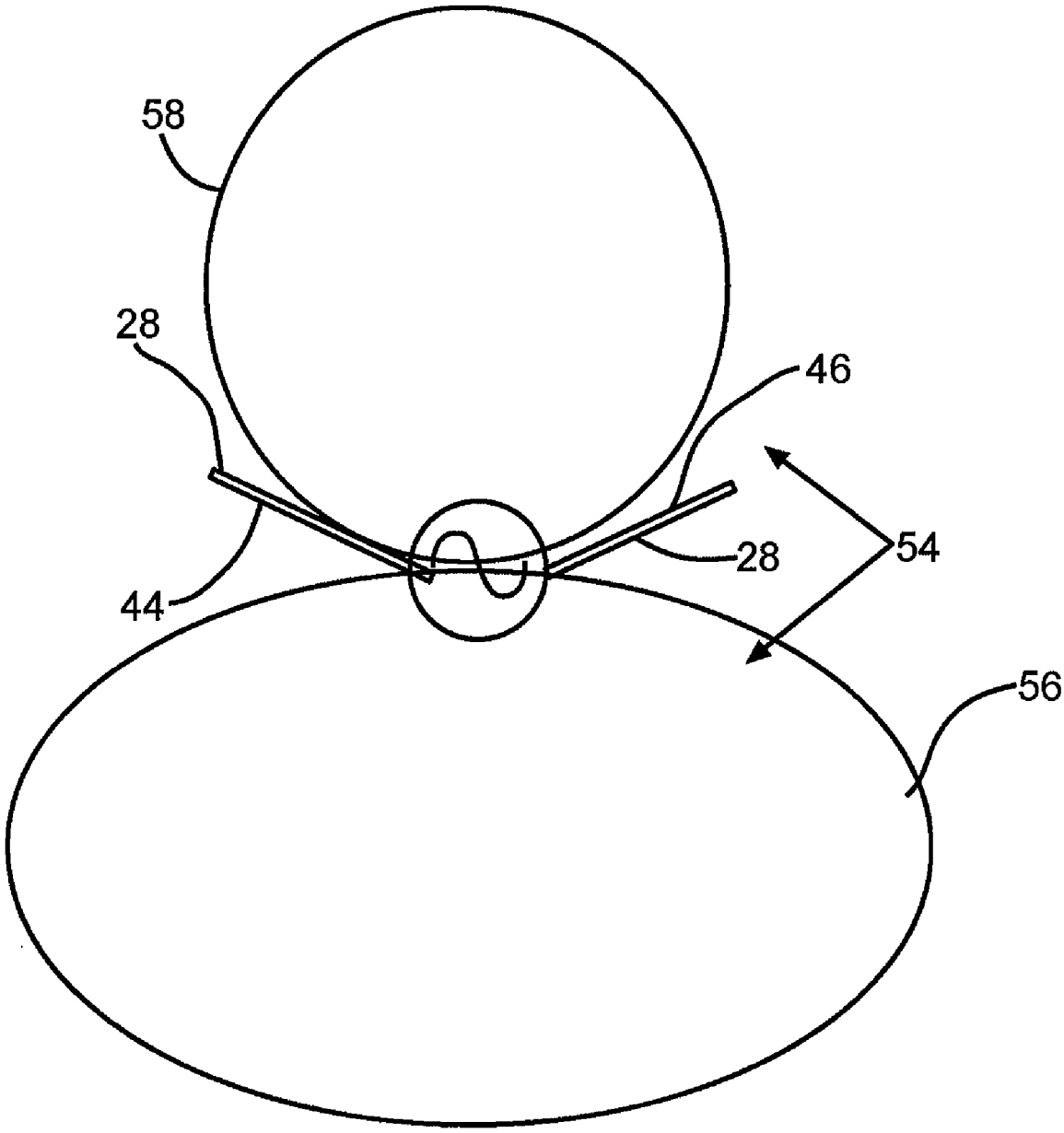
FIG. 3 shows a cross-section view of a radiation pattern which may result when the dipole assembly of FIG. 1 is disposed in free space.

FIG. 3 depicts a cross-section view of a radiation pattern 54 which may result when the dipole assembly 28 of FIGS. 1 and 2 is disposed in free space. As shown, by disposing the first and second arms 44 and 46 in the upward configuration, the downward radiation pattern 56 below the dipole assembly 28 is broadened, and the upward radiation pattern 58 above the dipole assembly 28 is narrowed.

Figure 4:
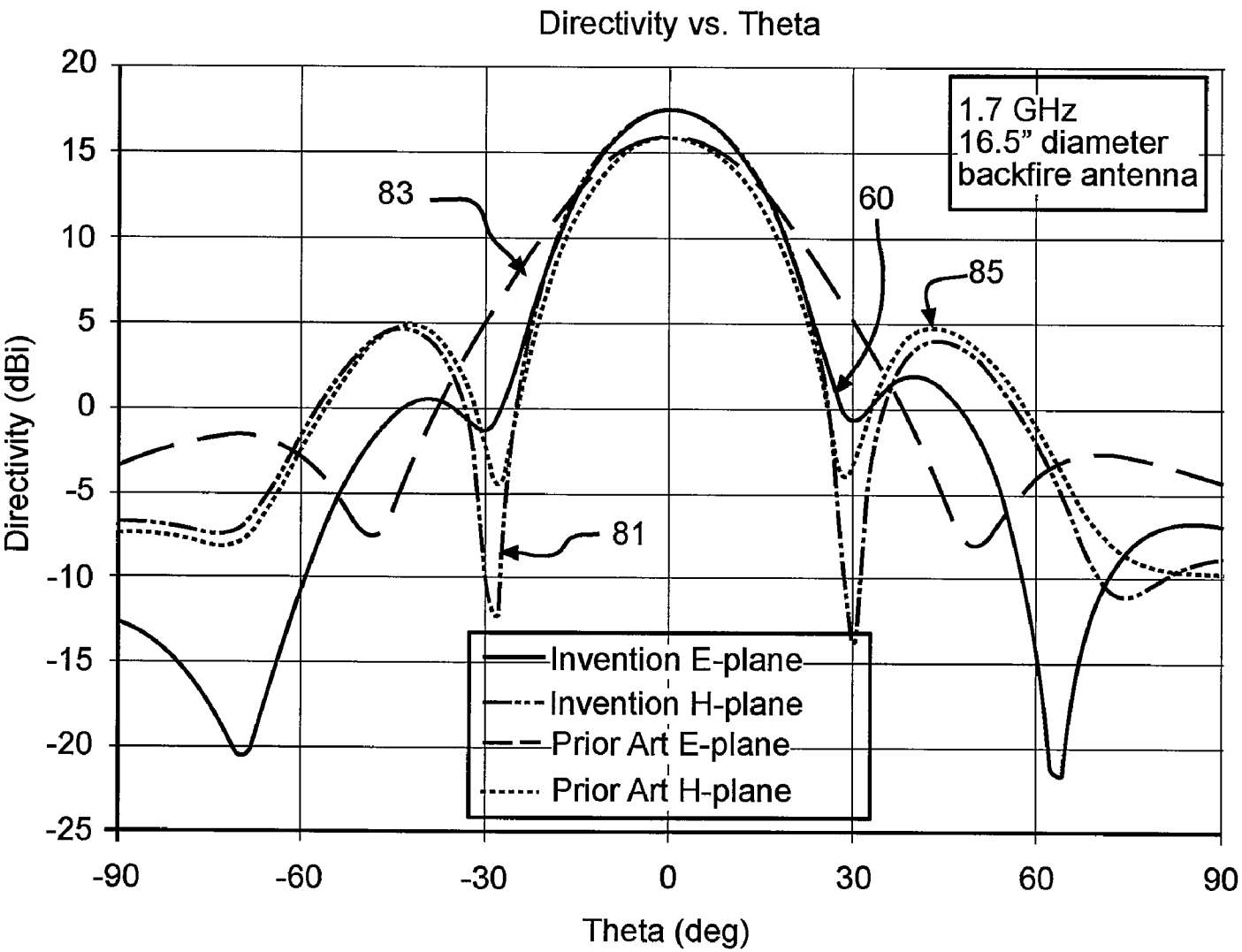
FIG. 4 shows the radiation pattern which may result from the embodiment shown in FIG. 1 compared to the radiation pattern of a prior art antenna.

FIG. 4 shows the radiation pattern 60 and 81 which may result from the embodiment shown in FIGS. 1 and 2, due to the upward configuration of the first and second arms 44 and 46. These patterns are compared in FIG. 4 with the e-plane pattern 83 and h-plane pattern 85 of a prior art antenna. As shown in FIGS. 2 and 3, the broader downward radiation pattern 56 below the dipole assembly 28, which radiates from the first and second arms 44 and 46 downward towards the interior 45 of the cavity 17 where it subsequently reflects off the interior surfaces 47 of the cavity 17, substantially uniformly illuminates the aperture 15 of the cavity 17 of the cup shaped member 16. The narrower upward radiation pattern 58 above the dipole assembly 28, which radiates from the first and second arms 44 and 46 upward towards the splash-plate 32 where it subsequently reflects off the splash-plate 32 towards the interior cavity 17, allows for the use of a smaller splash-plate 32 in order to reduce blockage of the aperture 15 of the cavity 17. In such manner, the efficiency of the antenna 10 may be improved over a prior art backfire antenna having a dipole assembly which is oriented parallel to the splash-plate which may experience poor aperture distribution in the aperture of the cavity, and which may require a larger splash-plate. Comparison of the side lobe structure of e-plane pattern 60 of the antenna 10, which shows distinct side lobes at theta=−40 and +40 degrees, and the e-plane pattern 83 of the prior art antenna, which has a broader beam width but no side lobes until theta=−70 and +70 degrees, demonstrates to those familiar with the art that the aperture distribution of antenna 10 is more uniform than the prior art antenna.

Figure 5:
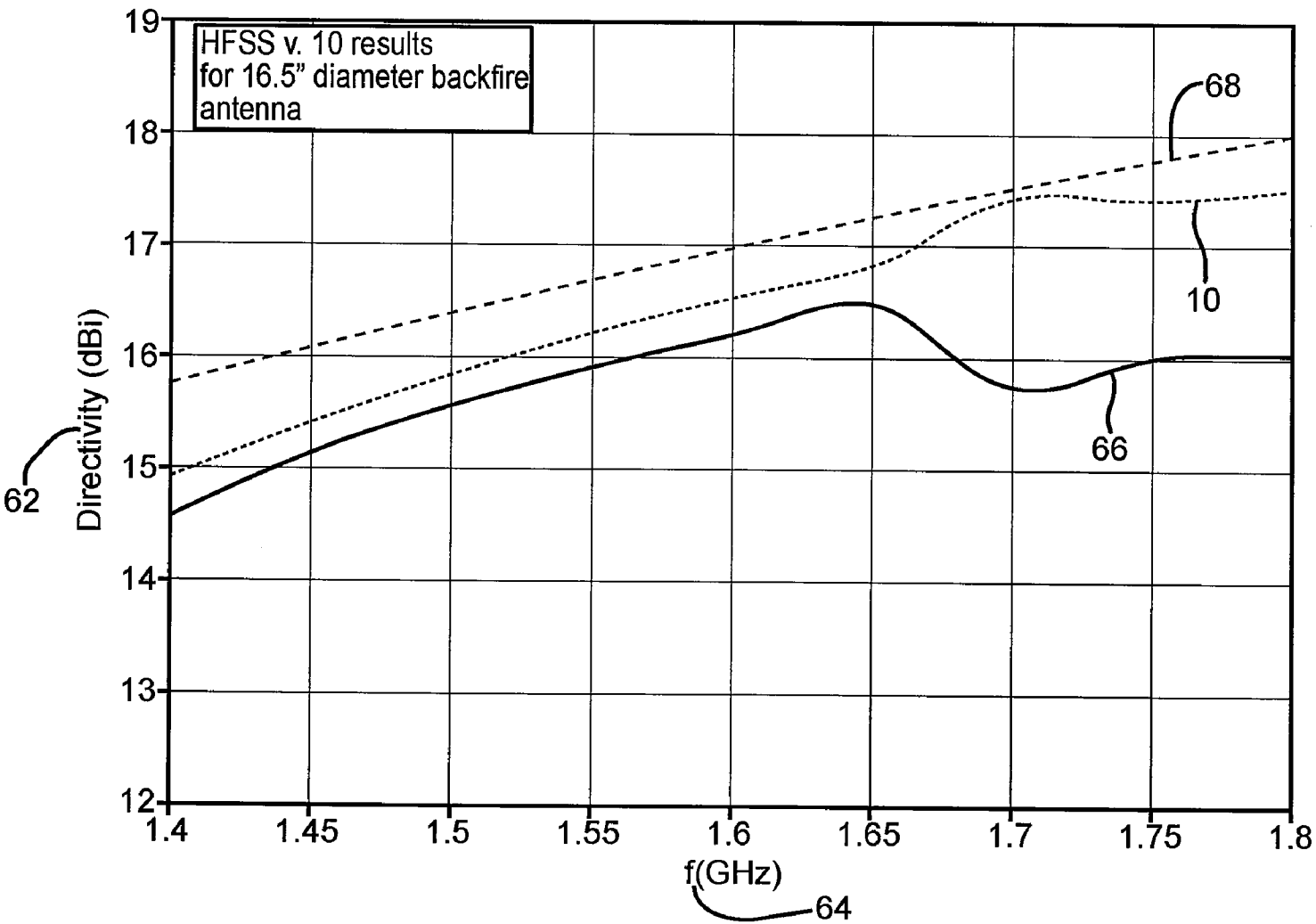
FIG. 5 shows a plot of peak directivity versus frequency comparing a prior art backfire antenna, the antenna of the embodiment of FIG. 1, and a theoretical antenna having 100 percent aperture efficiency.

FIG. 5 shows a plot of directivity 62 versus frequency 64 comparing a prior art backfire antenna 66 having a dipole assembly which is oriented parallel to the splash-plate, the antenna 10 of the embodiment of FIG. 1 having a V-shaped dipole assembly 28, and a theoretical antenna 68 having 100 percent aperture efficiency. As shown, the upward orientation of the dipole assembly 28 of FIG. 1 produces a higher directive gain than the prior art backfire antenna 66.

Figure 6:
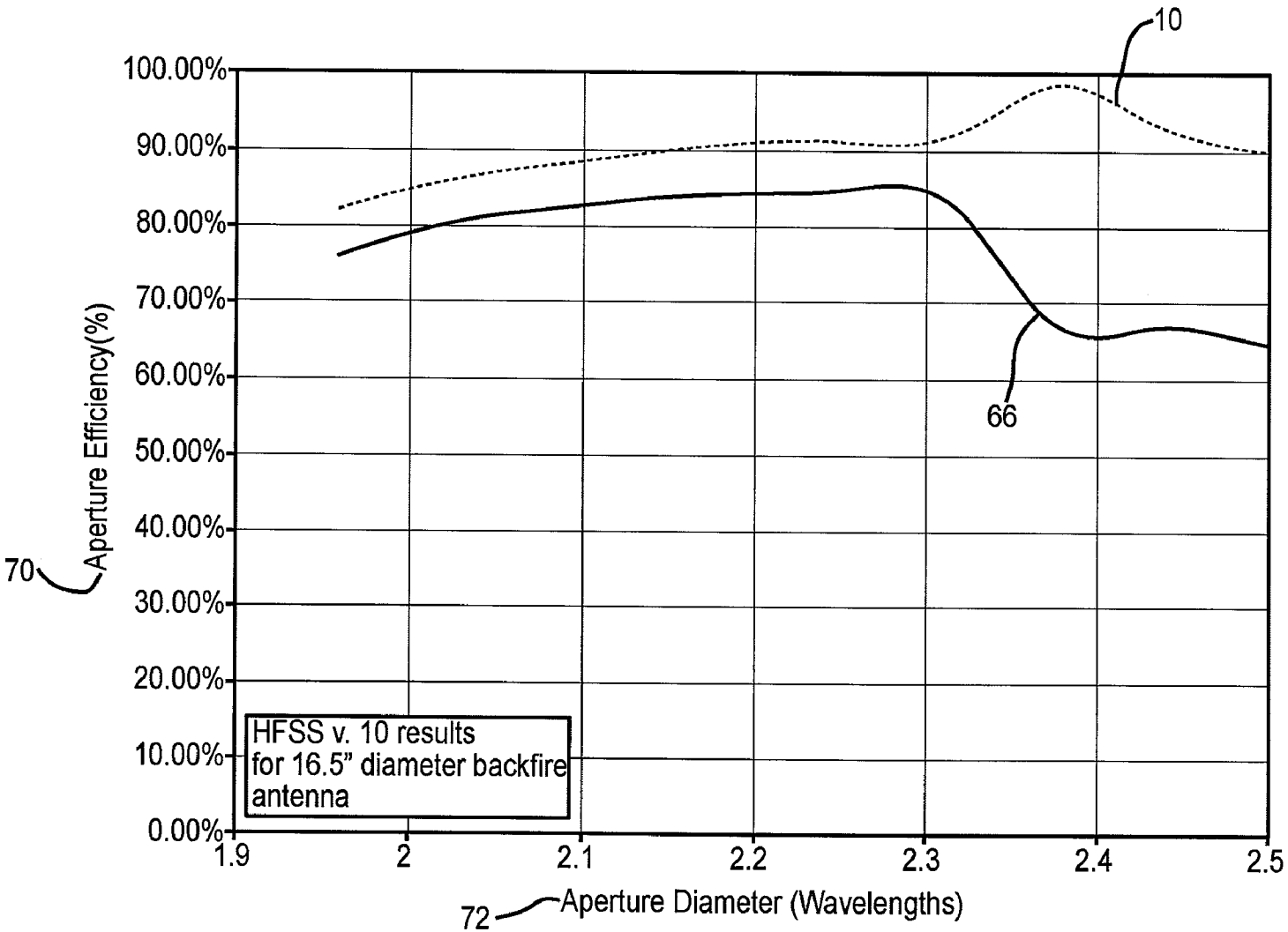
FIG. 6 shows a plot of aperture efficiency versus aperture diameter comparing a prior art backfire antenna, and the antenna of the embodiment of FIG. 1.

FIG. 6 shows a plot of aperture efficiency 70 versus aperture diameter 72 comparing a prior art backfire antenna 66 having a dipole assembly which is oriented parallel to the splash-plate, and the antenna 10 of the embodiment of FIG. 1 having a V-shaped dipole assembly 28. As shown, the upward orientation of the dipole assembly 28 of FIG. 1 results in higher efficiency than the prior art backfire antenna 66.

Figure 7:
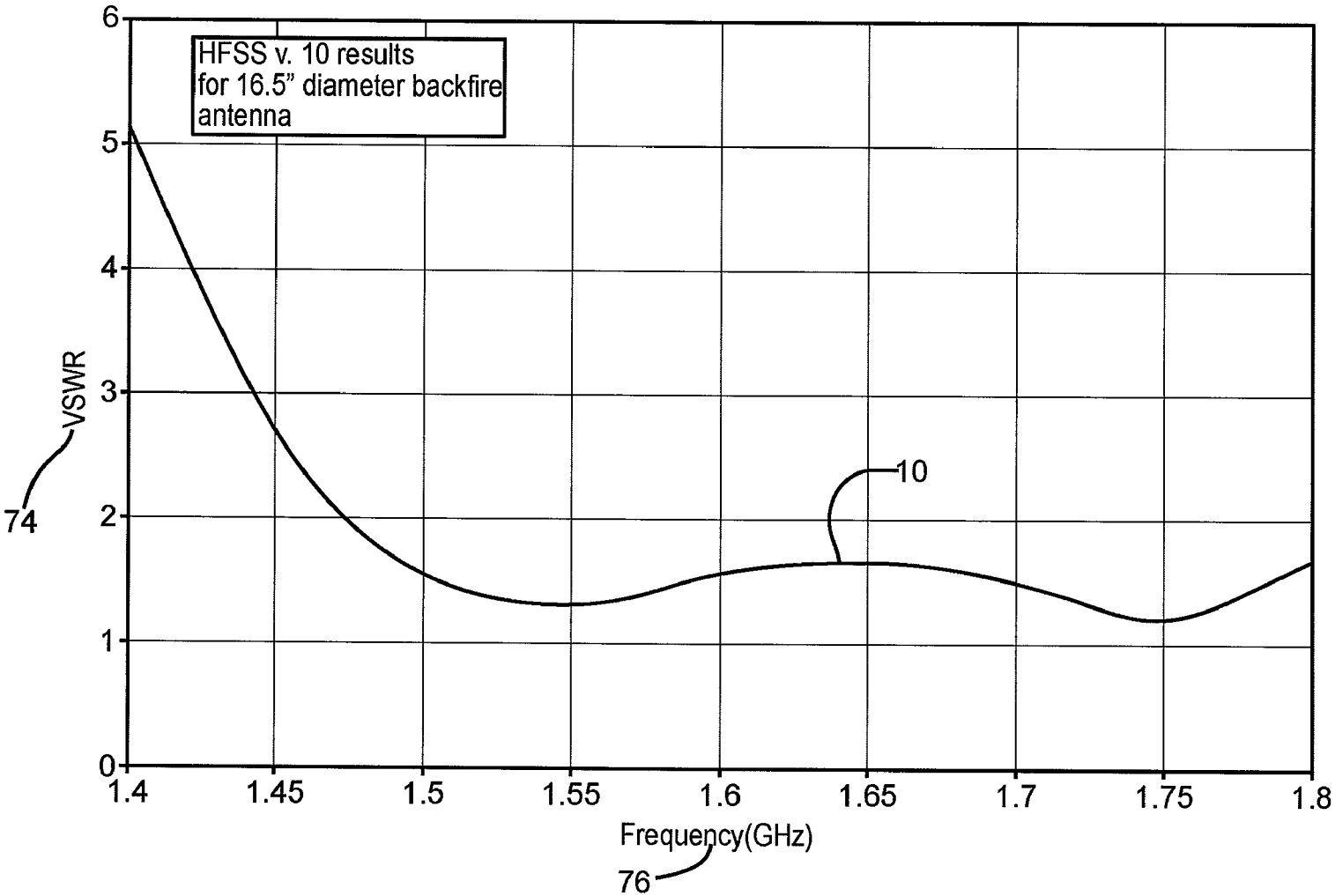
FIG. 7 shows a plot of voltage standing wave ratio (VSWR) versus frequency for the antenna of the embodiment of FIG. 1.

FIG. 7 shows a plot of voltage standing wave ratio (VSWR) 74 versus frequency 76 for the antenna 10 of the embodiment of FIG. 1 having a V-shaped dipole assembly 28. As shown, the upward orientation of the dipole assembly 28 of FIG. 1 results in a low VSWR, which is below 2 from 1.475 GHz to greater than 1.8 GHz in frequency. This is a good result since it shows that not much power is being reflected back into the antenna 10, unlike prior art backfire antenna 66.

Figure 8:
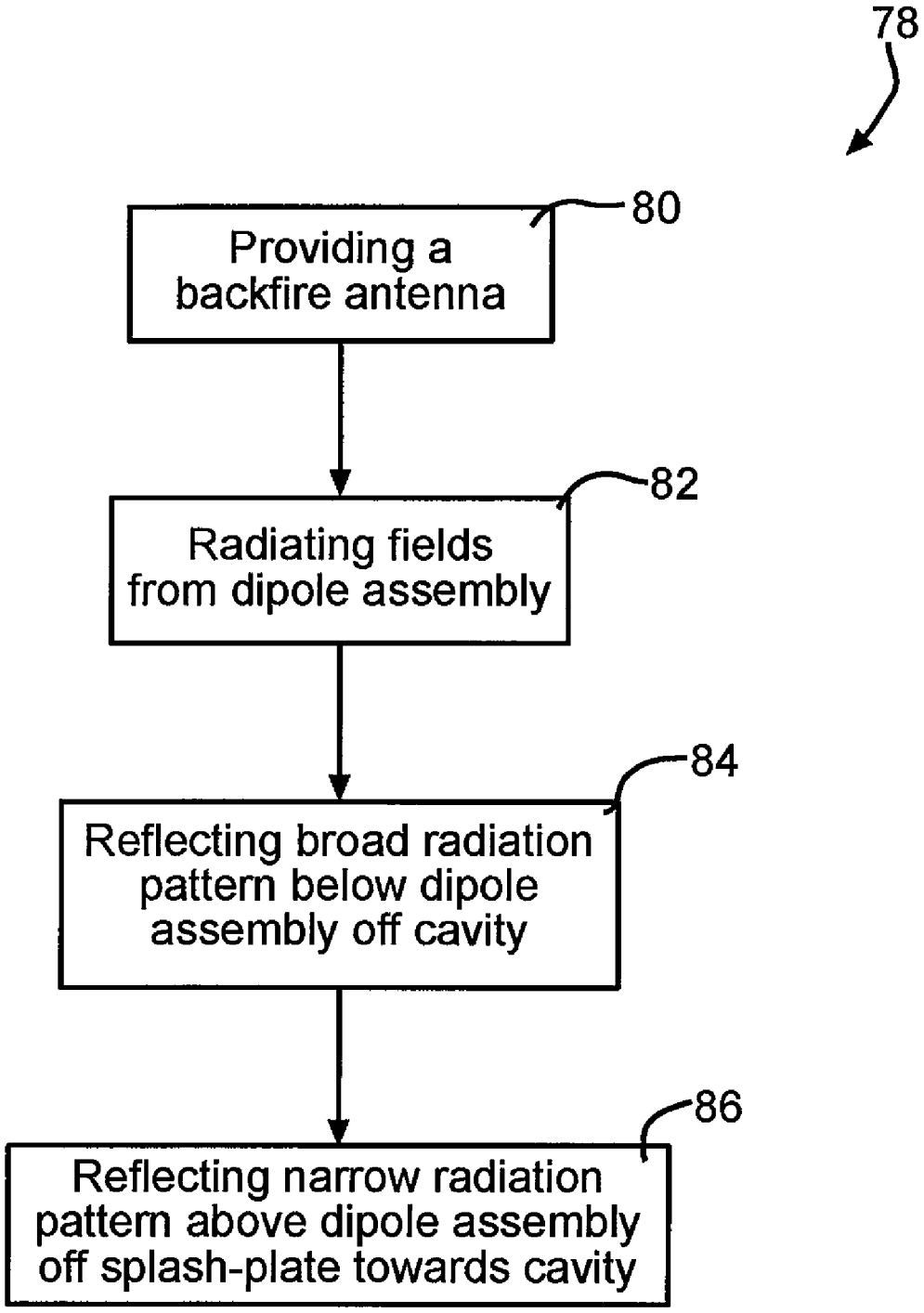
FIG. 8 is a flowchart showing one embodiment of a method of using a backfire antenna.

FIG. 8 shows one embodiment of a method 78 of using a backfire antenna 10. In one step 80, a backfire antenna 10 is provided. The backfire antenna 10 may comprise any of the embodiments disclosed herein, and may be used in any of the disclosed applications. In one embodiment, the backfire antenna 10 may comprise a cup-shaped member 16 defining an outer aperture 15 and an interior cavity 17, a splash-plate 32 disposed within a plane 52, and a dipole assembly 28 comprising first and second arms 44 and 46. The first and second arms 44 and 46 are both oriented non-parallel to the splash-plate 32 towards the plane 52.

In another step 82, fields may be radiated by currents on the first and second arms 44 and 46 of the dipole assembly 28. The orientation of the first and second arms 44 and 46 produces a broad radiation pattern 56 below the first and second arms 44 and 46, and a narrow radiation pattern 58 above the first and second arms 44 and 46. In still another step 84, the broad radiation pattern 56 may be reflected off one or more surfaces 47 of the interior cavity 17. In yet another step 86, the narrow radiation pattern 58 may be reflected off the splash-plate 32 towards the interior cavity 17. The orientation of the first and second arms 44 and 46 may produce a high directive gain, may produce a high efficiency, may produce a low voltage standing wave ratio, and may allow for the use of a small splash-plate 32 due to the narrow radiation pattern 58 above the first and second arms 44 and 46. This may be an improvement over the prior art backfire antenna 66.

It should be understood, of course, that the foregoing relates to exemplary embodiments of the disclosure and that modifications may be made without departing from the spirit and scope of the disclosure as set forth in the following claims.

The invention claimed is:

1. A backfire antenna comprising:

a cup-shaped member defining an outer aperture and an interior cavity;

a splash-plate disposed within a plane; and a dipole assembly comprising first and second arms, wherein the first and second arms are both oriented non-parallel to the splash-plate towards the plane, fields are radiated by currents on the first and second arms, and the orientation of the first and second arms produces a broad radiation pattern below the first and second arms and a narrow radiation pattern above the first and second arms.

2. The backfire antenna of claim 1 wherein the backfire antenna is for usage in at least one of a vehicle, a satellite, in space, and in water.

3. The backfire antenna of claim 1 wherein a diameter of the cavity is in a range of 2 to 2.5 wavelengths.

4. The backfire antenna of claim 1 wherein the backfire antenna further comprises a feed network.

5. The backfire antenna of claim 1 wherein the splash-plate is disposed at or near the outer aperture.

6. The backfire antenna of claim 1 wherein the dipole assembly is disposed within the cavity below the splash-plate.

7. The backfire antenna of claim 1 wherein the dipole assembly is V-shaped.

8. The backfire antenna of claim 1 wherein the first and second arms each have a length in the range of ⅙ to ⅓ wavelengths.

9. The backfire antenna of claim 1 wherein each of the first and second arms are oriented upwardly at angles within a range of 15 to 35 degrees relative to a horizontal plane.

10. The backfire antenna of claim 1 wherein each of the first and second arms are oriented upwardly at angles of 30 degrees relative to a horizontal plane.

11. The backfire antenna of claim 1 wherein the orientation of the first and second arms produces a high directive gain, a high efficiency, and allows for the splash-plate to be small.

12. The backfire antenna of claim 1 wherein the orientation of the first and second arms produces a low voltage standing wave ratio.

13. The backfire antenna of claim 1 wherein the splash-plate is circular.

14. A method of using a backfire antenna comprising:

providing a backfire antenna comprising a cup-shaped member defining an outer aperture and an interior cavity, a splash-plate disposed within a plane, and a dipole assembly comprising first and second arms, wherein the first and second arms are both oriented non-parallel to the splash-plate towards the plane;

radiating fields by currents on the first and second arms, wherein the orientation of the first and second arms produces a broad radiation pattern below the first and second arms, and produces a narrow radiation pattern above the first and second arms;

reflecting the broad radiation pattern off surfaces of the interior cavity; and reflecting the narrow radiation pattern off the splash-plate towards the interior cavity.

15. The method of claim 14 wherein the method of using the backfire antenna is employed in at least one of a vehicle, a satellite, in space, and in water.

16. The method of claim 14 wherein a diameter of the cavity is in a range of 2 to 2.5 wavelengths.

17. The method of claim 14 wherein the backfire antenna further comprises a feed network.

18. The method of claim 14 wherein the splash-plate is disposed at or near the outer aperture.

19. The method of claim 14 wherein the dipole assembly is disposed within the cavity below the splash-plate.

20. The method of claim 14 wherein the dipole assembly is V-shaped.

21. The method of claim 14 wherein the first and second arms each have a length in the range of ⅙ to ⅓ wavelengths.

22. The method of claim 14 wherein each of the first and second arms are oriented upwardly at angles within a range of 15 to 35 degrees relative to a horizontal plane.

23. The method of claim 14 wherein each of the first and second arms are oriented upwardly at angles of 30 degrees relative to a horizontal plane.

24. The method of claim 14 wherein the orientation of the first and second arms produces a high directive gain, produces a high efficiency, and allows for the splash-plate to be small.

25. The method of claim 14 wherein the orientation of the first and second arms produces a low voltage standing wave ratio.

26. The method of claim 14 wherein the splash-plate is circular.

* * * * *